US008801452B2

(12) United States Patent
Wang

(10) Patent No.: US 8,801,452 B2
(45) Date of Patent: Aug. 12, 2014

(54) ELECTRONIC DEVICE HAVING ASSISTING APPARATUS FOR UNPLUGGING RJ-45 CONNECTOR

(71) Applicant: Jun-Hui Wang, Shenzhen (CN)

(72) Inventor: Jun-Hui Wang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 43 days.

(21) Appl. No.: 13/629,493

(22) Filed: Sep. 27, 2012

(65) Prior Publication Data

US 2014/0065870 A1 Mar. 6, 2014

(30) Foreign Application Priority Data

Aug. 30, 2012 (CN) ..... 2012 1 0314577

(51) Int. Cl.
*H01R 13/62* (2006.01)

(52) U.S. Cl.
USPC ..... 439/352

(58) Field of Classification Search
USPC ..... 439/352
See application file for complete search history.

(56) References Cited

U.S. PATENT DOCUMENTS

| | | | | |
|---|---|---|---|---|
| 7,182,623 | B1 * | 2/2007 | Lewis | 439/352 |
| 7,407,402 | B2 * | 8/2008 | Peng et al. | 439/352 |
| 7,465,180 | B2 * | 12/2008 | Kusuda et al. | 439/352 |
| 7,578,692 | B2 * | 8/2009 | Kaneda | 439/352 |
| 8,353,715 | B1 * | 1/2013 | Zhou | 439/352 |
| 8,512,062 | B1 * | 8/2013 | Zhou | 439/352 |
| 2005/0075001 | A1 * | 4/2005 | Shearman et al. | 439/352 |
| 2013/0237082 | A1 * | 9/2013 | Zhou | 439/352 |

* cited by examiner

*Primary Examiner* — Gary Paumen
(74) *Attorney, Agent, or Firm* — Novak Druce Connolly Bove + Quigg LLP

(57) ABSTRACT

An assisting apparatus for unplugging a connector from a socket of an electronic device includes a fixing arm mounted to the electronic device adjacent to the socket, a press arm, and a connection piece connected between the fixing arm and the press arm. The press arm is capable of being moved to contact and press a resilient plate of the connector that is engaged with a sidewall bounding the socket to allow the resilient plate to disengage from the sidewall bounding the socket.

3 Claims, 3 Drawing Sheets

ELECTRONIC DEVICE HAVING ASSISTING APPARATUS FOR UNPLUGGING RJ-45 CONNECTOR

BACKGROUND

1. Technical Field

The present disclosure relates generally to electronic devices and, particularly, to an electronic device having an assisting apparatus for unplugging a Registered Jack-45 (RJ-45) connector.

2. Description of Related Art

RJ-45 connectors are widely used in network communication. However, unplugging an RJ-45 connector manually from a connector of an electronic device can be difficult and inconvenient because of the limited space for maneuver.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
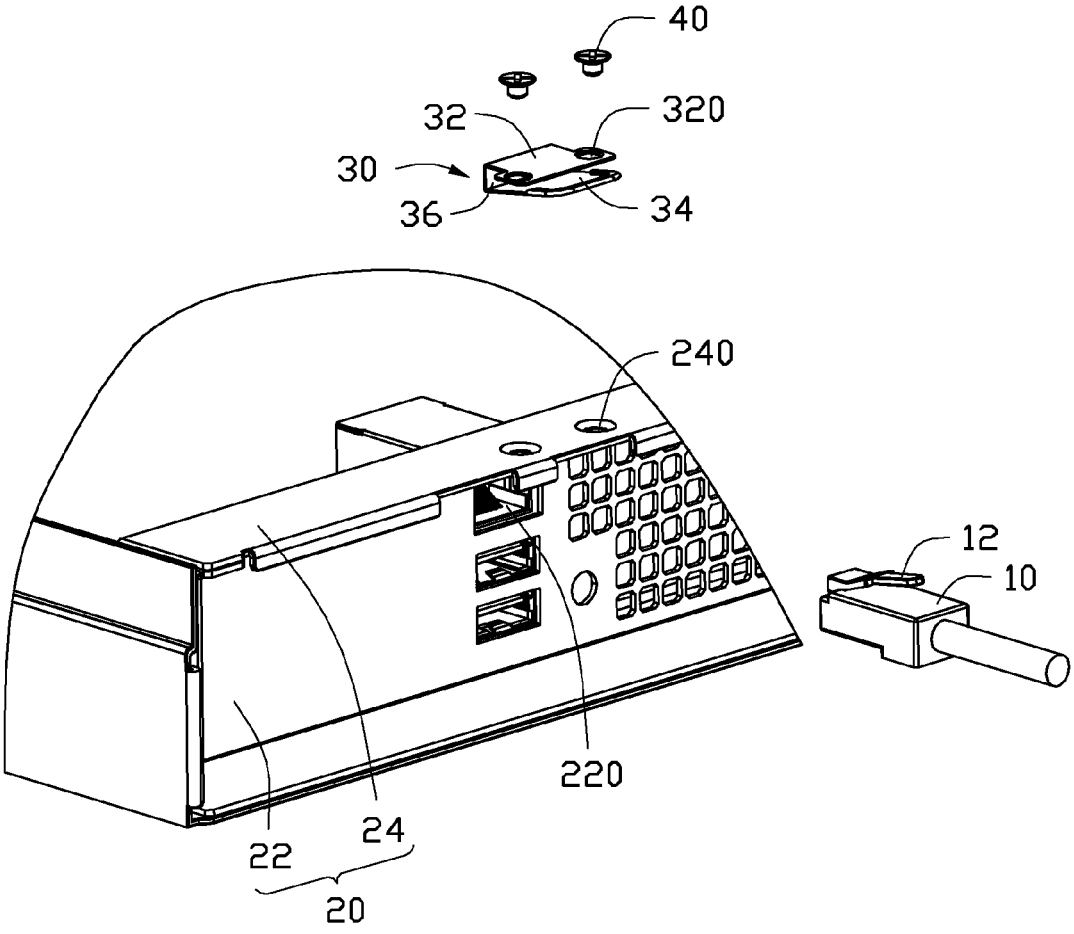
FIG. 1 is an exploded, isometric view of an exemplary embodiment of an electronic device together with a Registered Jack-45 (RJ-45) connector, wherein the electronic device includes an assisting apparatus for unplugging the RJ-45 connector.

FIG. 1 shows an exemplary embodiment of an electronic device including a chassis 20, and an assisting apparatus 30 for unplugging a Registered Jack-45 (RJ-45) connector 10.

The chassis 20 includes a sidewall 22 and an extension plate 24 perpendicularly extending out from a top of the sidewall 22. A socket 220 is mounted inside the chassis 20 and exposed through the sidewall 22. The extension plate 24 defines two through holes 240 above the socket 220.

The assisting apparatus 30 includes a resilient connection piece 36, a fixing arm 32, and a press arm 34 extending out from top and bottom sides of the connection piece 36 in a same direction. The fixing arm 32 defines two threaded holes 320. The press arm 34 is longer than the fixing arm 32 in the extension direction, and slantingly extends toward the fixing arm 32. Therefore, an acute angle is formed between the press arm 34 and the connection piece 36.

The RJ-45 connector 10 is connected to the socket 220. A resilient tab 12 slantingly extends up and back from a front end of a top of the RJ-45 connector 10, for engaging with a sidewall of the socket 220.

Figure 2:
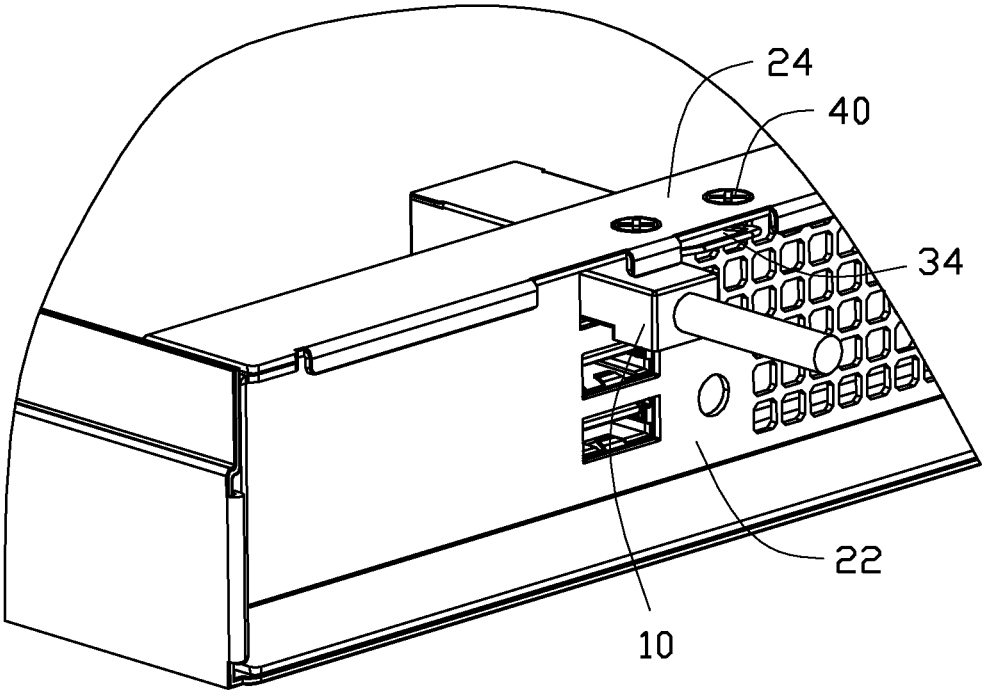
FIG. 2 is an assembled, isometric view of FIG. 1.

Referring to FIG. 2, in assembly, two screws 40 extend through the through holes 240 and then are respectively engaged in the threaded holes 320, to fix the assisting apparatus 30 to a bottom surface of the extension plate 24. The fixing arm 32 and the press arm 34 are positioned above the resilient plate 12. The connection piece 36 faces the sidewall 22. The rear side of the press arm 34 is extended out from the extension plate 24 and capable of being pressed toward the resilient plate 12.

Figure 3:
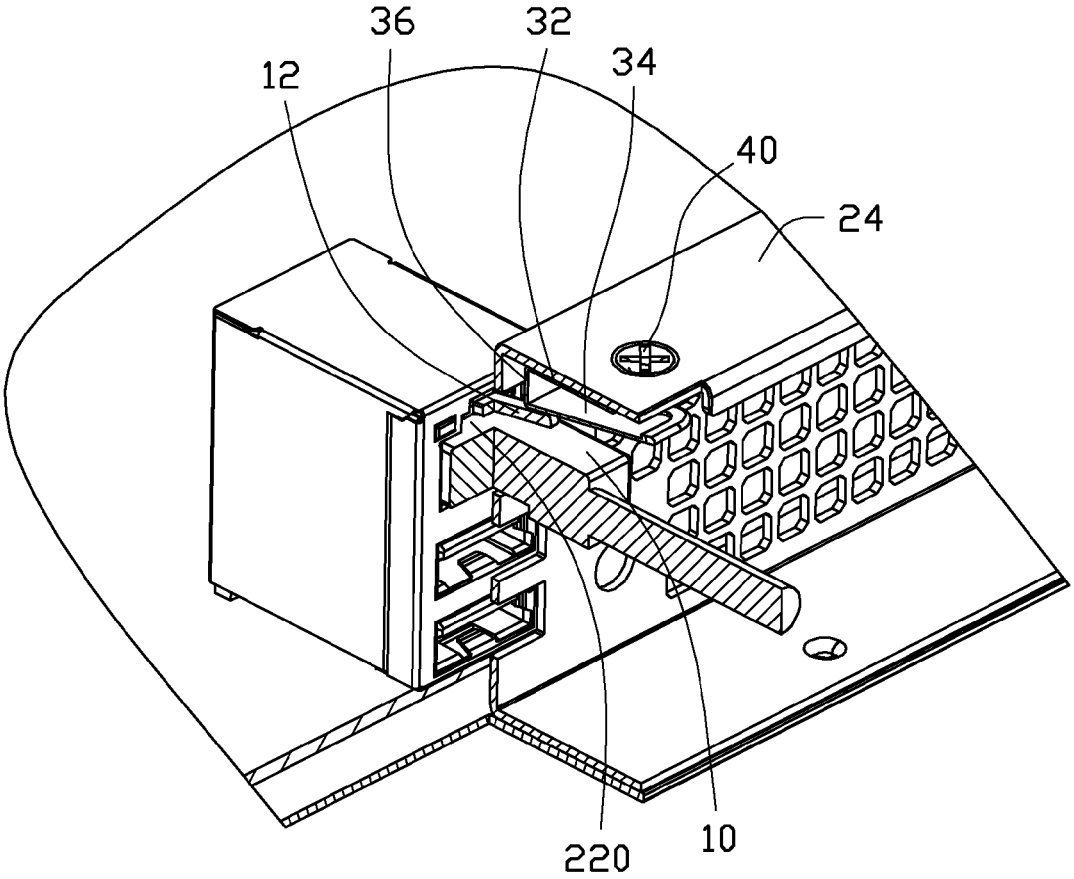
FIG. 3 is a partially cutaway view of FIG. 2.

Referring to FIG. 3, to unplug the RJ-45 connector 10 from the socket 220, the rear side of the press arm 34 is pressed down under deforming the connection piece 36, to contact and press down the resilient plate 12, thereby disengaging the resilient plate 12 from the sidewall of the socket 220. Thereby, the RJ-45 connector 10 can be detached from the socket 220.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. An electronic device, comprising:

a sidewall comprising a socket;

an extension plate perpendicularly extending out from the sidewall;

a connector comprising a resilient plate engaging with a sidewall bounding the socket; and an assisting apparatus mounted to the extension plate and comprising a press arm capable of being moved to contact and press the resilient plate to allow the resilient plate to disengage from the sidewall bounding the socket, wherein the assisting apparatus further comprises a fixing arm mounted to the extension plate and a resilient connection piece connected between the fixing arm and the press arm.

2. The electronic device of claim 1, wherein the fixing arm and the press arm extend from opposite ends of the connection piece in a same direction.

3. The electronic device of claim 2, wherein the press arm slantingly extends toward the fixing arm.

* * * * *